US006406287B1

(12) United States Patent
Vesa et al.

(10) Patent No.: US 6,406,287 B1
(45) Date of Patent: Jun. 18, 2002

(54) DEVICE FOR FORMING FIBER BALLS OF ELONGATED FIBERS CARRIED IN AN AIR FLOW

(75) Inventors: Juha Vesa; Kimmo Martelin; Mikko Vesa, all of Turku (FI)

(73) Assignee: Goodroll Oy, Turku (FI)

( * ) Notice: Subject to any disclaimer, the term of this patent is extended or adjusted under 35 U.S.C. 154(b) by 0 days.

(21) Appl. No.: 09/600,245

(22) PCT Filed: Jan. 13, 1999

(86) PCT No.: PCT/FI99/00017

§ 371 (c)(1),
(2), (4) Date: Aug. 17, 2000

(87) PCT Pub. No.: WO99/36609

PCT Pub. Date: Jul. 22, 1999

(30) Foreign Application Priority Data

Jan. 14, 1998 (FI) ..... 980053

(51) Int. Cl.[7] ..... D04H 1/00
(52) U.S. Cl. ..... 425/332; 264/117
(58) Field of Search ..... 425/332, 333; 264/117, 112

(56) References Cited

U.S. PATENT DOCUMENTS 1,575,283 A * 3/1926 Schiff ..... 425/332
2,331,510 A * 10/1943 Schiff ..... 425/333
2,914,797 A * 12/1959 Cavanagh ..... 425/333
4,065,599 A 12/1977 Nishiumi et al.
4,164,534 A 8/1979 Ogino
4,747,550 A * 5/1988 Jackering
4,886,701 A 12/1989 Ehnert et al.
5,218,740 A 6/1993 Snyder
5,429,783 A * 7/1995 Kirkbride ..... 264/117

* cited by examiner

*Primary Examiner*—James P. Mackey
(74) *Attorney, Agent, or Firm*—Nixon & Vanderhye P.C.

(57) ABSTRACT

The invention relates to a device for forming fibre balls out of elongated fibres carried in an air flow. The device contains a stator chamber (1) which is fixed to a frame and which has a circular cross section, and coaxially within it there is arranged a rotor (2), also having a circular cross section, and being rotatable around its shaft (3), whereby the rotor has on its periphery a plurality of radial blades (12, 12') at mutual peripheral distances and at a short distance from the inner wall (1') of the stator (1) in order to form an annular intermediate space (14) extending over the axial length of the rotor between the inner wall (1') of the stator (1) and the blades (12, 12') of the rotor (2). Further, means (8–10) are fastened to the frame and functionally connected to the shaft (3) of the rotor for rotating the rotor, and moreover, the device contains an input opening (5) at one end of the stator chamber (1) and an output opening (7) at the opposite end of the rotor chamber (1) in order to remove and to separate from the air flow the fibre balls formed in the intermediate space (14). According to the invention the stator chamber (1) and the rotor (2) are substantially conical, and they can be mutually positioned in the axial direction in order to adjust the width of said intermediate space without having to remove the rotor (2) from the stator chamber (1) in order to adjust the blades (12, 12').

19 Claims, 5 Drawing Sheets

DEVICE FOR FORMING FIBER BALLS OF ELONGATED FIBERS CARRIED IN AN AIR FLOW

This invention relates to a device for forming fibre balls of elongated fibres carried in an air flow. Particularly this relates to such a device having a stator chamber with a circular cross section in which there is arranged coaxially with it a rotor which also has a circular cross section and which is rotatable around its axis and has on its periphery a plurality of circumferentially spread radial blades at a short distance from the stator's inner wall, whereby fibres carried by the air flow are directed from the input opening at one end of the stator chamber into said intermediate space and removed through an output opening at the opposite end of the rotor chamber in order to separate fibre balls from the air flow.

Fibres are generally used as stuffing in upholstery. In order to make upholstery as spongy as possible the fibres are often made into spongy fibre balls with a rather smooth surface so that the balls are resilient and also able to move in relation to each other, in order to make the stuffing as loose as possible. There are previously known devices for forming balls of opened fibres carried in an air flow. Due to the surface friction the opened fibres carried in the air flow are attached to each other forming floccules of different sizes and forms. These floccules are not as such suitable for a stuffing material as there are fibre ends protruding from them which easily are attached to fibres protruding from other floccules. Therefore the floccules are preferably formed into balls.

Such ball forming devices are known for instance from the U.S. Pat. Nos. 4,747,550 and 5,429,783. In these previously known devices the opened fibres carried in the air flow are formed into balls in the intermediate space formed by the inner wall of a cylindrical stator chamber and the periphery of a rotor arranged coaxially within the stator. A plurality of transverse discs are arranged spaced from each other on the rotor shaft, whereby at the outer edges of the discs there are at mutual peripheral distances fastened radial blades having outer edges which end at a short distance from the inner wall of the rotor chamber. Air and fibres are supplied to the lower part of the rotor chamber and blown from there further upwards, whereby the fibres are formed into balls in the intermediate space formed by the outer edges of the blades and the inner wall of the stator chamber when they are carried upwards in this intermediate space. Then the fibre balls are sucked from the upper part of the stator chamber into a cyclone separator where the fibre balls are separated from the conveying air.

The gap between the outer edge of the blades and the internal wall of the stator chamber is in these devices generally 4 mm, but it can be made larger depending on the length and other characteristics of the fibres to be treated. However, in these devices it is a cumbersome and time-consuming task to alter the gap. In order to adjust the blades the rotor chamber must be opened and the rotor removed from the rotor chamber, after which the fastening of each blade must be loosened, adjusted and refastened. The blades are situated in many planes, and each plane contains many blades, and thus it is obvious that the blade adjustment operation is quite tricky and takes a long time.

The object of the present invention is to remove the above-mentioned disadvantage and to provide a device of the type presented in the preamble of claim 1 for forming fibre balls of elongated fibres carried in an air flow, whereby the device is novel and original in that the stator chamber and the rotor are substantially conical and that they can be mutually positioned in the axial direction.

With the solution according to the invention the intermediate space between the inner wall of the stator chamber and the blades of the rotor can be adjusted in a rapid and simple manner so that is suitable for each fibre quality, without having to open the stator chamber in order to remove the rotor from it, and without having to loosen, adjust and refasten the blades and without having to rearrange the rotor into the stator chamber and close the stator chamber. Thanks to the conical shape of the combination of stator chamber and rotor said intermediate space changes when the stator chamber and/or rotor is moved in the axial direction. The intermediate space changes the more the larger the coning angle is, and the more the greater the axial movement is.

In a preferred embodiment of the invention the blades are located on a plurality of axial planes, so that the blades on one plane are peripherally displaced in relation to the blades in the adjacent plane or planes. The angle of displacement is preferably 3 to 5 degrees, for instance 4 degrees in relation to the blades on the next plane.

Further, the blades on different planes are preferably separated from each other by circular plates, which are transverse in relation to the rotor shaft and of which the top plate has a radius which is substantially smaller than the radial length of the rotors below it. These solutions present a particularly advantageous and effective ball forming of elongated fibres. The blades are generally at a mutual distance of 20 degrees in the direction of the rotor periphery, whereby the blades are advantageously on 4 to 6 planes, for instance on 5 planes.

In a particularly preferred embodiment of the invention the combination of stator chamber and rotor is in a substantially vertical position and widens downwards, whereby the input opening is at the upper end of the stator chamber. Thanks to the conical shape of the combination of stator chamber and rotor there is formed a so called tornado effect in the intermediate space between the stator chamber and the rotor when the gas flow accelerates as it propagates in a spiral manner towards the wider end of the conical combination of stator chamber and rotor. The velocity of the gas flow increases as the peripheral distance is increased but at the same time the time used for one revolution is kept substantially the same. As the velocity of the gas flow increases its pressure will correspondingly decrease, there is in other words created a pressure difference between the ends of the combination of stator chamber and rotor, and this pressure difference tends to force the flow combination against that end of the combination having the larger diameter. When the combination of the stator chamber and the rotor is in a substantially vertical position and widens downwards the above mentioned effect is assisted by the gravity, and thus it is effectively secured that the small fibre balls move towards the output opening at the lower end of the combination.

It has been found that the forming of balls is particularly effective when a part of the blade is bevelled at the outer edge, on the trailing side as seen in the rotation direction, whereby the bevelling angle of the blades is advantageously about 5 to 45 degrees.

Further the forming of balls can be made more effective by means of heating elements in the sheath of the stator chamber, preferably with heating resistors covering the sheath, and by means of a shelf extending around the inner wall of the lower end of the sheath.

Preferably there is further at least one collecting funnel between the output opening and the lower end of the stator chamber for receiving the fibre balls. The funnel is preferably connected to a negative pressure source for removing the fibre balls from the funnel and then for separating them from the carrying air in a manner known per se.

Further there can be a perforated separating chamber between the input opening and the stator chamber in order to remove excessive air from the fibre containing air flow before it is supplied to said intermediate space.

Advantageously the rotor is axially positioned in relation to the stator chamber so that the intermediate space is 4 to 10 mm. Then the coning angle of the combination of the stator chamber and rotor is preferably selected such that an axial displacement of 10 mm between the rotor and the stator chamber corresponds to a change in the intermediate space of about 0.1 to 1.5 mm, for instance 1 mm.

Further the speed of rotation of the rotor is advantageously controlled in a stepless manner.

A device according to the invention is designed so that it can be rapidly and easily adjusted to be suitable for fibres of very different lengths and qualities.

In order to increase the retention time it is possible to connect a plurality of inventive devices in series, and preferably so that the rotational speed of each device can be individually controlled.

The invention is described below in more detail with reference to the enclosed drawings, in which.

Figures 3A, 3B:
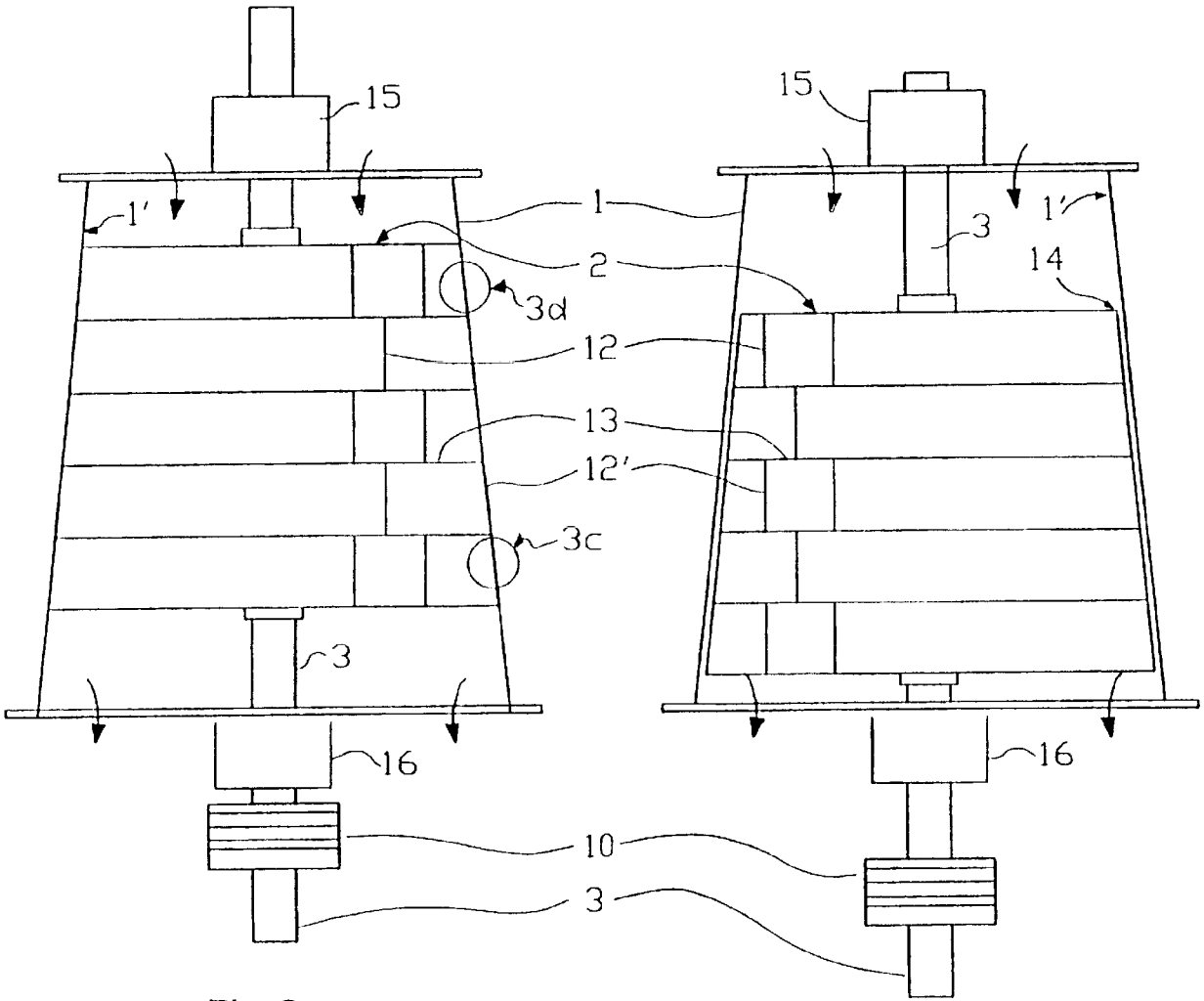
Figure 3C:
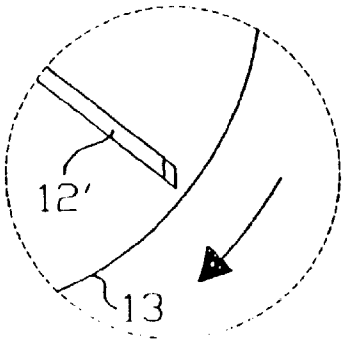
Figure 3D:
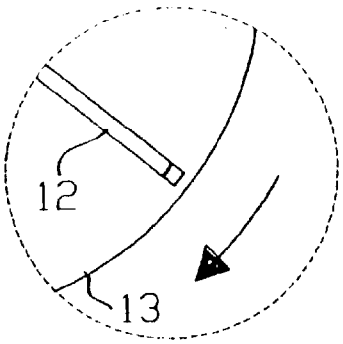

FIGS. 3*a* and 3*b* show in a cross section a vertical view of the combination of stator chamber and rotor axially adjusted in different positions;

FIGS. 3*c* and 3*d* show details of FIG. 3*a;*

Figure 4:
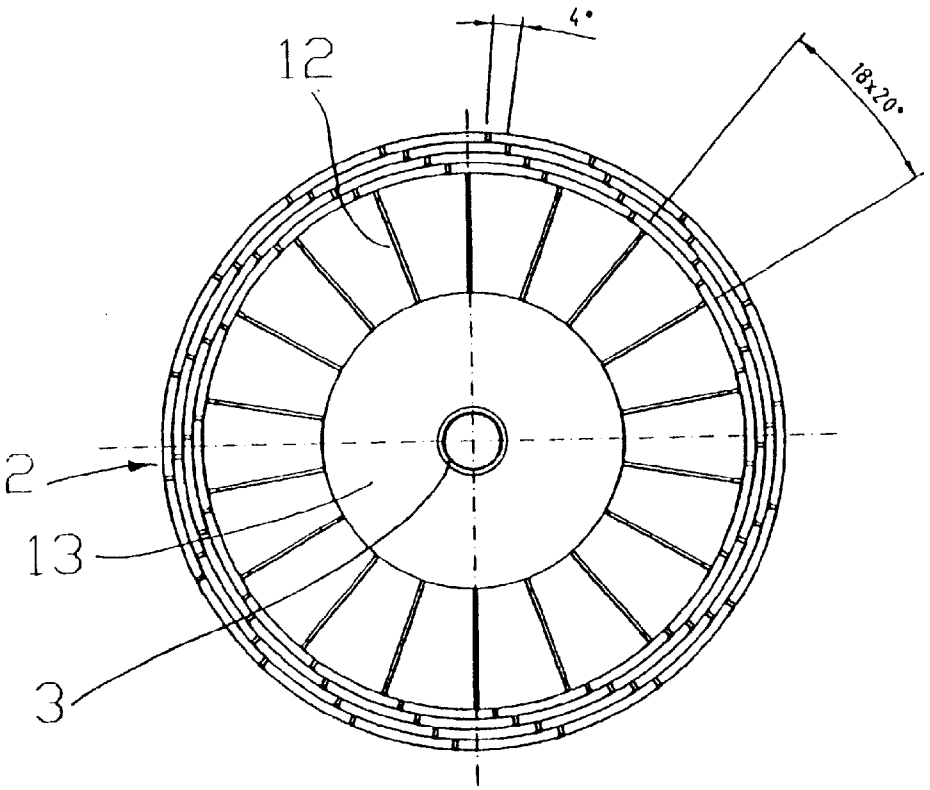

FIG. 4 shows a top view of the stator; and

Figure 1:
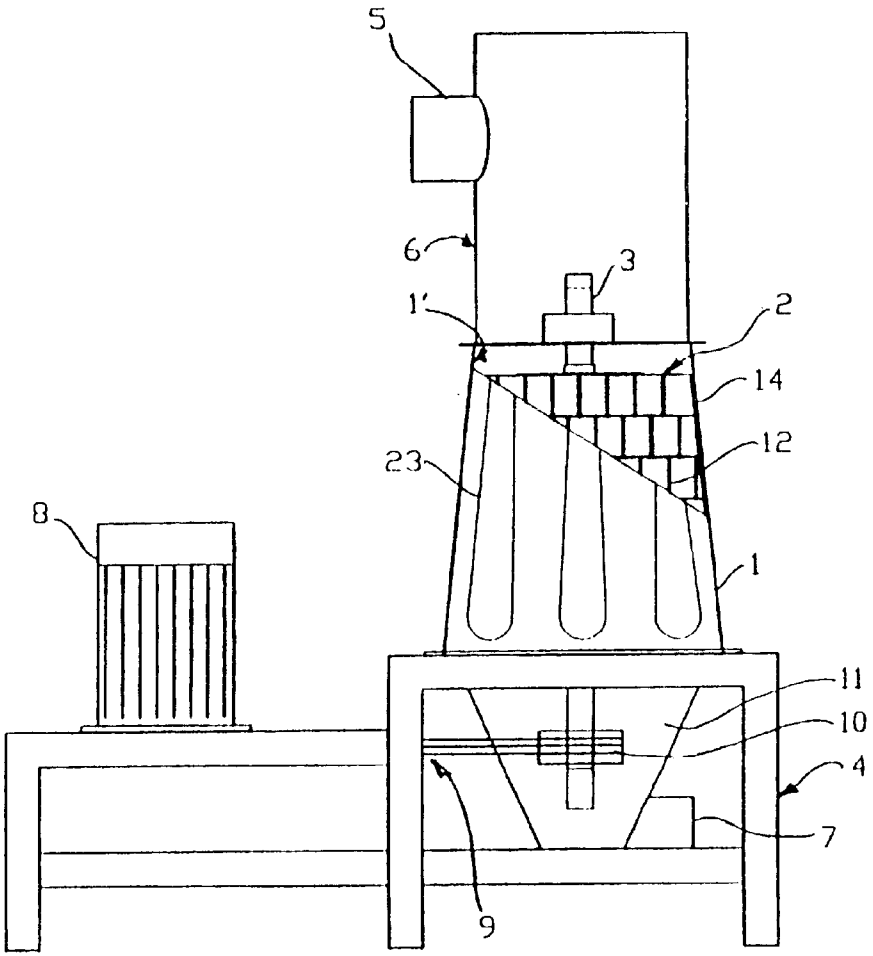
FIG. 1 shows a partly cut side view of a preferred embodiment of the invention.
Figure 5:
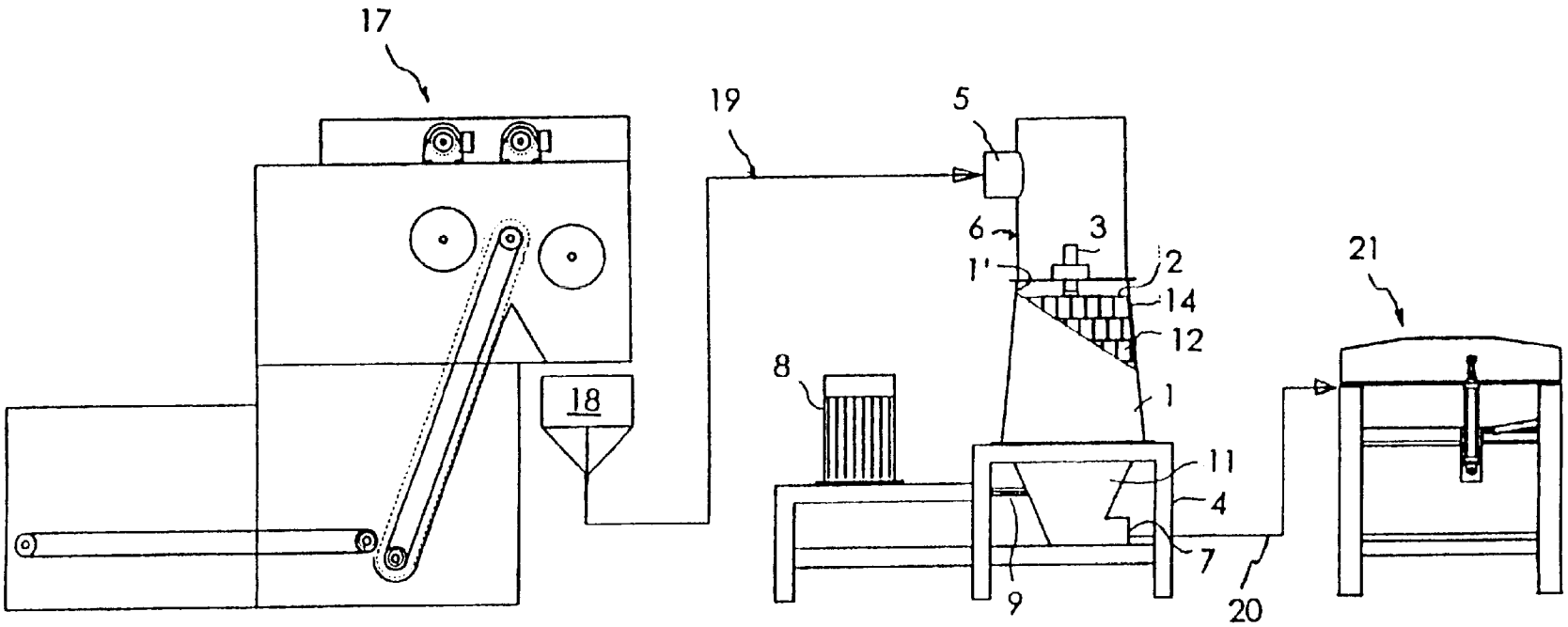

FIG. 5 shows a partly cut side view of the device in FIG. 1 with its external devices.

Figure 2:
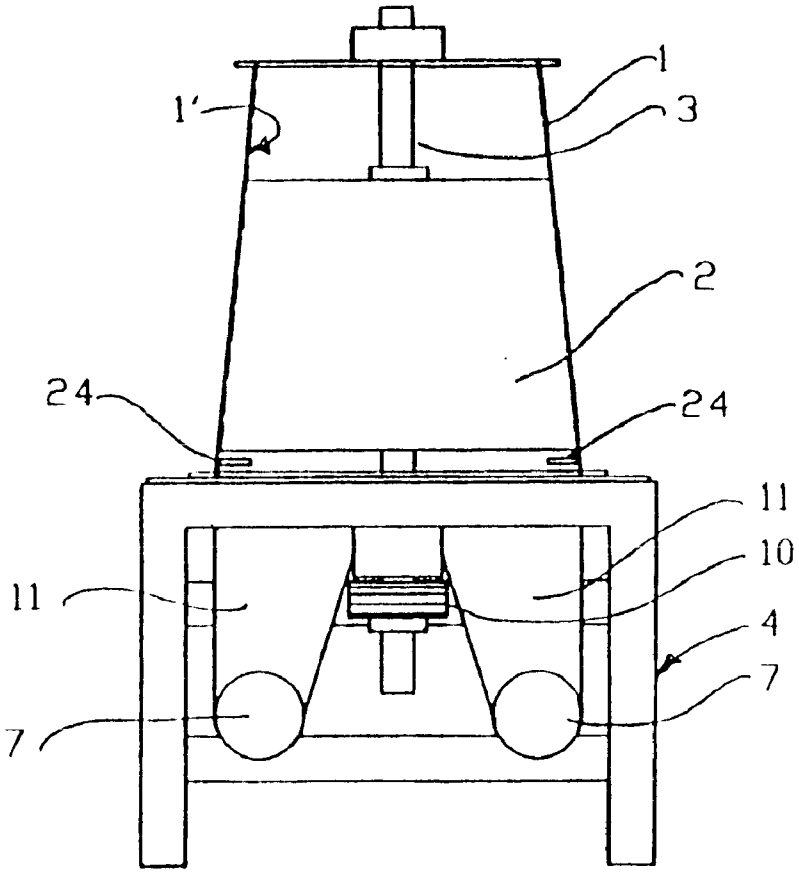
FIG. 2 shows an end view of the same device, without its upper part.

In FIGS. 1 and 2 the frame of the device is generally marked by the reference numeral 4. On the frame 4 there is detachably fastened a substantially vertical stator chamber 1 with a frustoconical form so that the chamber tapers upwards, whereby the stator chamber's sheath contains an electrically heated resistor element 23 which has been found to essentially increase the effect of ball forming. Within the stator chamber 1 there is a rotor 2 arranged to rotate around a vertical shaft 3, whereby the rotor has the same form as the stator chamber 1 but is lower. The rotor 2 is further axially adjustable in order to adjust the width of the intermediate space 14 formed between the inner wall 1' of the stator chamber 1 and the periphery of the rotor 2 according to the length and other characteristics of the fibres to be formed into balls. The positioning or control device is not presented in more detail, as such means are obvious to a person skilled in the art and quite common in the industry. A net funnel 6 is arranged at the upper end of the stator chamber 1 having an input opening 5 at the upper part for directing the opened fibres carried by the conveying air into the stator chamber 1 and for removing excessive air through the holes in the net funnel 6 before that. At the lower end of the stator chamber 1 there is further a narrow shelf 24 extending around its inner wall 1' which has been found to improve the forming of balls. Further below the lower end of the stator chamber 1 and fastened to the frame 4 there are two funnels 11 having output openings 7 at their lower ends for sucking out fibre balls and conveying air and directing them to a previously known cyclone separator (not shown) in order to recover the fibre balls. Further there is a top bearing 15 and a bottom bearing 16 on the shaft 3 of the rotor 2 (shown in FIGS. 3*a* and 3*b*), and moreover, at the lower end of the shaft 3 there is a pulley 10, with which the rotor shaft is rotatably connected via the belt 9 to the driving mechanism 8 fastened to the frame 4 in order to rotate the rotor 2 around the shaft 3.

The combination of stator chamber 1 and rotor 2 is shown in more detail in FIGS. 3*a* and 3*b*. In FIG. 3*a* the rotor 2 is positioned in the higher position, and in FIG. 3*b* in the lower position in order to increase the intermediate space 14. It can be seen that the coning angles of the stator chamber 1 and the rotor 2 are identical, but that the rotor 2 is lower than the stator chamber 1.

In relation to the shaft 3 the rotor 2 is divided by transverse discs 13 at mutual axial distances into five planes, of which discs the disc at the top has a substantially smaller diameter than the other discs, as can be seen in more detail in FIG. 4. The blades 12, 12' are fastened between the discs 13 so that they are vertical and directed radially away from the shaft 3, so that their outer edges end at a short distance from the inner wall 1' of the rotor chamber 1. There are 18 blades 12, 12' in each plane, which results in an angle of 20 degrees between the blades. Additionally the blades on one plane are laterally displaced in relation to the blades on the next plane, whereby the displacement angle is 4 degrees between the planes, as can be seen in more detail in FIG. 4.

The FIGS. 3*c* and 3*d* show that the blades 12 on the upper planes differ slightly from the blades 12' on the lower planes, which have outer edges bevelled on the trailing side, as seen in the rotation direction shown with an arrow, what has been found to be particularly effective in furthering the forming of balls. The bevelling angle is preferably about 30 degrees.

When the rotor 2 rotates around its shaft 3 it generates in the stator chamber 1 a downwardly directed spiral flow between the rotor and the inner wall 1' of the stator chamber 1, whereby the velocity of the flow increases as it passes downwards because the distance of one revolution increases even though the time required by one revolution is kept substantially the same. Correspondingly, the pressure of the flow decreases, and thus there is created a pressure difference between the upper and lower ends of the intermediate space 14 which pressure difference assists the flow of air in carrying the fibres and fibre balls downwards towards the funnels 11.

FIG. 5 shows a device according to the invention with external devices before and after it. In FIG. 5 the device tearing up fibre bundles is generally marked with the reference numeral 17, from which the opened fibres fall onto the weighing device 18, and from there a predetermined weighed fibre charge is blown along the pipe 19 to the input opening 5 at the upper part of the rotor chamber 1.

From the output opening 7 at the lower part of the funnel 11 the fibre balls are directed along the pipe 20 directly to a stuffing device of pillows or corresponding articles, whereby the stuffing device is generally marked with the reference numeral 21. The stuffing device 21 is preferably a continuously operating device, whereby it has at least two stuffing stations, to which fibre balls are alternately supplied. The conveying air is separated from the fibre balls by sucking air through the cover to be stuffed by a sucking device arranged after the stuffing station.

It is obvious that the invention is not limited to the embodiment shown in the enclosed figures, but the invention can be varied quite widely within the scope defined by the appended claims. Thus for instance the number, the form and the location of the blades in the rotor, as well as the number of planes can be widely varying. It is also possible that the combination of stator chamber and rotor widens upwards, whereby the output opening is at the upper end of the stator chamber and the input opening at its lower end. With this solution it is easier to control the forming of balls. The coning angle of the combination of stator chamber and rotor can also be some other angle than that shown in the figures, and it is not necessary that the inner wall of the stator chamber is exactly straight, but it may be slightly convex or concave in the same way as the periphery of the rotor. However, regarding the manufacturing techniques it is advantageous that the wall is straight.

What is claimed is:

1. A device for forming fiber balls out of elongated fibers carried in an air flow, wherein the device comprises:

a frame, a stator chamber fixed to the frame and having a circular cross section and an inner wall;

a rotor also having a circular cross section and being arranged coaxially within the stator chamber and rotatable around its shaft, whereby the rotor has on its periphery a plurality of radial blades at mutual peripheral distances and at a short distance from the inner wall of the stator chamber in order to form an annular intermediate space extending over the axial length of the rotor between the inner wall of the stator chamber and the blades of the rotor;

means fastened to the frame and functionally connected to the shaft of the rotor for rotating the rotor;

an input opening at one end of the stator chamber for directing fibers carried by the air flow into said intermediate space as a turbulent flow propagating spirally in the direction of the shaft; and an output opening at the opposite end of the stator chamber in order to remove and to separate from the air flow the fiber balls formed in said intermediate space, wherein the stator chamber and the rotor are substantially conical for mutually positioning in the axial direction.

2. A device according to claim 1, wherein the blades are arranged on a plurality of planes in the axial direction, so that the blades on one plane are transversally displaced in the peripheral direction in relation to the blades on an adjacent plane or adjacent planes.

3. A device according to claim 2, wherein the blades are displaced in an angle of 3 to 5 degrees in relation to the blades on the next plane.

4. A device according to claim 2, wherein the blades on different planes are separated from each other by circular discs which are transverse in relation to the shaft of the rotor.

5. A device according to claim 1, wherein the blades on one plane form an angle of 20 to 40 degrees to the adjacent blades.

6. A device according to claim 2, wherein there are blades on 4 to 6 planes.

7. A device according to claim 1, wherein the combination of stator chamber and rotor is in a substantially vertical position and widens downwards, whereby the input opening is at the upper end of the stator chamber.

8. A device according to claim 1, wherein at least a part of the blades is beveled at an outer edge on the trailing side relative to the rotation direction.

9. A device according to claim 8, wherein all blades on one plane, or on a plurality of planes, are beveled at their outer edges on the trailing side relative to the rotation direction.

10. A device according to claim 7, wherein all blades on at least the two lowest planes are beveled at their outer edges on the trailing side relative to the rotation direction.

11. A device according to claim 8, wherein the blades are beveled at an angle from about 5 to 45 degrees.

12. A device according to claim 1, further comprising heater elements in the sheath of the stator chamber (1).

13. A device according to claim 7, further comprising a shelf extending around the inner wall of the lower end of the stator chamber.

14. A device according to claim 7, comprising at least one funnel positioned between the output opening and the lower end of the stator chamber for receiving fiber balls, wherein the funnel is connected to a negative pressure source for removing the fiber balls from the funnel and for separating the fiber balls from the conveying air.

15. A device according to claim 1, wherein the rotor can be axially positioned in relation to the stator chamber so that the intermediate space is 4 to 10 mm.

16. A device according to claim 1, wherein the coning angle of the combination of stator chamber and rotor is such that an axial displacement of 10 mm between the rotor and the stator chamber corresponds to a change of 0.5 to 1.5 mm in the intermediate space.

17. A device according to claim 2, wherein the blades are displaced in an angle of 4 degrees in relation to the blades on the next plane.

18. A device according to claim 12, wherein the heater elements are heater resistors.

19. A device according to claim 1, wherein the coning angle of the combination of stator chamber and rotor is such that an axial displacement of 10 mm between the rotor and the stator chamber corresponds to a change of 1 mm in the intermediate space.

* * * * *